US005853309A

United States Patent [19]

Biggs

[11] Patent Number: 5,853,309

[45] Date of Patent: Dec. 29, 1998

[54] SWIMMING POOL FLOAT WITH ANCHORING SYSTEM

[76] Inventor: Sabrina P. Biggs, 8809 S. Point Pkwy. E. #1006, Phoenix, Ariz. 85044

[21] Appl. No.: 926,130

[22] Filed: Sep. 9, 1997

Related U.S. Application Data

[60] Provisional application No. 60/025,247, Sep. 16, 1996.

[51] Int. Cl.[6] ..... B63B 35/58

[52] U.S. Cl. ..... 441/40; 441/129; 114/294

[58] Field of Search ..... 114/293, 294, 114/345, 230; 441/40, 129, 130

[56] References Cited

U.S. PATENT DOCUMENTS

| | | | |
|---|---|---|---|
| 4,729,331 | 3/1988 | Eggleston | 114/230 |
| 4,775,346 | 10/1988 | Gunter et al. | 441/129 |
| 4,913,672 | 4/1990 | Martin | 114/294 |
| 4,968,278 | 11/1990 | Lemke et al. | 441/129 |
| 5,460,113 | 10/1995 | Gunter | 114/230 |

*Primary Examiner*—Stephen Avila
*Attorney, Agent, or Firm*—Joseph N. Breaux

[57] ABSTRACT

A swimming pool float with anchoring system including a flotation device, at least one float anchoring assembly secured to the flotation device, at least two pool anchoring assemblies securable to the cantilever side edge of a swimming pool, and a flexible anchoring line including a first securing mechanism securable to a float anchoring assembly and a second securing mechanism securable to one of the pool anchoring assemblies in a manner to anchor the flotation device to the cantilever side edge of the swimming pool. The float anchoring assembly preferably includes a section of hook and pile fastener material and a flexible cover member What folds over the section of hook and pile fastener material when nothing is secured thereto. Preferably, four float anchoring assemblies are included, with each of the anchoring assemblies being permanently secured to a cantilever side edge surface of the flotation device. The pool anchoring assemblies are essentially identical to the float anchoring assemblies, except the back surface of each of the pool anchoring assemblies is covered with a waterproof adhesive that in-turn is covered with a peel away cover member. The first and second securing mechanisms of the anchoring line are preferably sections of hook and pile fastener material that are secured to mounting plates that are slidably mounted on a loop of flexible nylon rope.

9 Claims, 3 Drawing Sheets

SWIMMING POOL FLOAT WITH ANCHORING SYSTEM

TECHNICAL FIELD

This application claims the benefits under 35 U.S.C. 119(e) of earlier filed provisional application Ser. No. 60/025,247, filed Sept. 16, 1996. The present invention relates to swimming pool flotation devices and more particularly to a swimming pool float with anchoring system that includes a flotation device having at least one float anchoring assembly positioned along the side edge thereof, a number of pool anchoring assemblies positionable about the cantilever side edge of a swimming pool along the perimeter edge thereof, and at least one anchoring line having a mechanism for attaching the anchoring line between the float anchoring assembly and one of the pool anchoring assemblies.

BACKGROUND OF INVENTION

Many individuals enjoy relaxing on a flotation device that is floating on the surface of a swimming pool or the like. The individual typically reclines on the flotation device and is supported above the water surface by the flotation device. It is often desirable to have drinks, books, suntan lotion, etc. within easy grasping range of the flotation device for relatively effortless retrieval of these items when they are desired. Because typical flotation devices are free floating, the flotation device can float freely within the pool and thus the decking surrounding the perimeter of the pool cannot be conveniently used for storing these items without the necessity for paddling or otherwise moving the flotation device back to the edge of the pool adjacent to the desired portion of decking when it is desired to retrieve an item from that location. It would be a benefit, therefore, to have a flotation device that included an anchoring system for anchoring the flotation device in convenient proximity to a portion of the edge of the swimming pool to allow a user of the flotation device to place desirable items along the edge of the pool for easy retrieval when desired. Because an individual may desire to anchor the flotation device at a variety of advantageous locations along the edge of the pool, it would be a further benefit if the anchoring system included a number of pool anchoring assemblies that were easily installed along the cantilever side edge of the swimming pool adjacent to the perimeter edge thereof. It would further be desirable to have a swimming pool flotation device with anchoring system that included an anchoring line that is easily detachable from the pool cantilever side edge while floating on the flotation device.

SUMMARY OF INVENTION

It is thus an object of the invention to provide a swimming pool float with an anchoring system that allows the flotation device to be anchored in convenient proximity to a portion of the edge of the swimming pool.

It is a further object of the invention to provide a swimming pool float with anchoring system that includes a number of pool anchoring assemblies that are easily installed along the cantilever side edge of swimming pool adjacent the perimeter edge thereof.

It is a still further object of the invention to provide a swimming pool float with anchoring system that includes an anchoring line that is easily detachable from the pool cantilever side edge while floating on the flotation device.

It is a still further object of the invention to provide a swimming pool float with anchoring system that accomplishes all or some of the above objects in combination.

Accordingly, a swimming pool float with anchoring system is provided. The swimming pool float with anchoring system comprises a flotation device, at least one float anchoring assembly secured to the flotation device, at least two pool anchoring assemblies securable to the cantilever side edge of a swimming pool, and a flexible anchoring line including a first securing mechanism securable to a float anchoring assembly and a second securing mechanism securable to one of the pool anchoring assemblies in a manner to anchor the flotation device to the cantilever side edge of the swimming pool.

The flotation device can be any conventional swimming pool type flotation device that is inflatable or constructed from buoyant material. The float anchoring assembly preferably includes a section of hook and pile fastener material and a flexible cover member that folds over the section of hook and pile fastener material when nothing is secured thereto. Preferably, four float anchoring assemblies are included, with each of the anchoring assemblies permanently secured to a cantilever side edge surface of the flotation device to allow the anchoring line to be secured to the float at a number of locations on the flotation device.

The pool anchoring assemblies are essentially identical to the float anchoring assemblies, except the back surface of each of the pool anchoring assemblies is covered with a waterproof adhesive and then covered with a peel away cover member. This allows each of the pool anchoring assemblies to be easily and conveniently affixed to the cantilever side edge of the swimming at a desirable location.

The anchoring line includes first and second securing mechanisms that include a section of hook and pile fastener material that is secured to mounting plate that, in-turn, is secured to a loop of flexible rope. The mounting plates are preferably slidably mounted onto the loop of flexible rope and constructed of a sufficient quantity buoyant material to float at the surface of the pool when not attached to a float or pool anchor assembly. In addition, to aid a user in disconnecting the first and second securing mechanisms, the mounting plates are preferably constructed from a resilent material to allow the sections of hook and pile material to be torn free of its counterpart hook and pile section on the float and pool anchor assemblies.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

As discussed hereinabove the swimming pool float with anchoring system of the present invention includes a flotation device, at least one float anchoring assembly secured to the flotation device, at least two pool anchoring assemblies securable to the cantilever side edge of a swimming pool, and a flexible anchoring line including a first securing mechanism securable to a float anchoring assembly and a second securing mechanism securable to one of the pool anchoring assemblies in a manner to anchor the flotation device to the cantilever side edge of the swimming pool.

Figure 1:
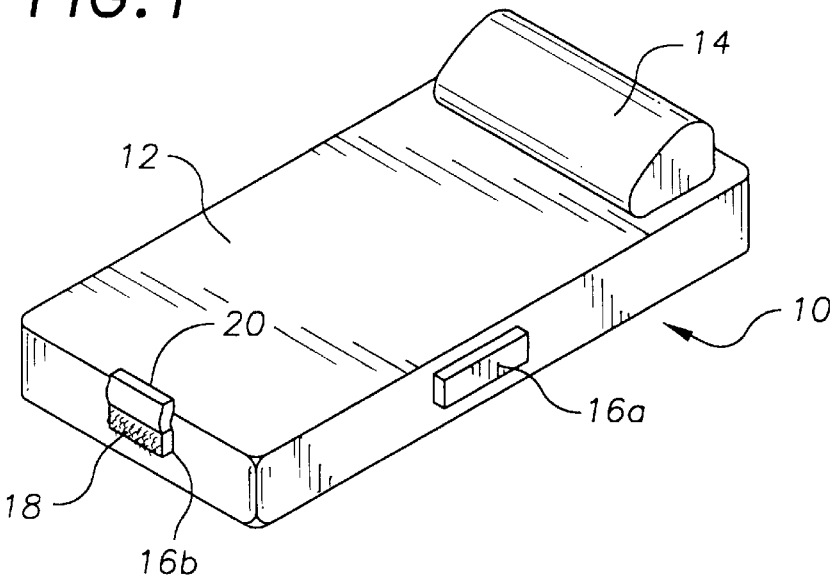
FIG. 1 is a perspective view of an exemplary embodiment of the flotation device showing two of the four identical float anchoring assemblies permanently mounted thereto. The cover member of one of the float anchoring assemblies is folded upward to show a section of pile material from a hook and pile fastener. The cover member of the second float anchoring assembly is shown in the down position covering the section of pile material.

FIG. 1 shows an exemplary flotation device, generally designated 10. In this embodiment, flotation device 10 includes a body support 12 and a head support 14. Body support 12 is a substantially rectangular section of buoyant foam rubber having head support 14 integrally formed on a top surface thereof. Although the exemplary embodiment of flotation device 10 is constructed from buoyant foam rubber, the flotation device can be any conventional swimming pool type flotation device and can be inflatable or constructed from other buoyant materials.

Figure 2:
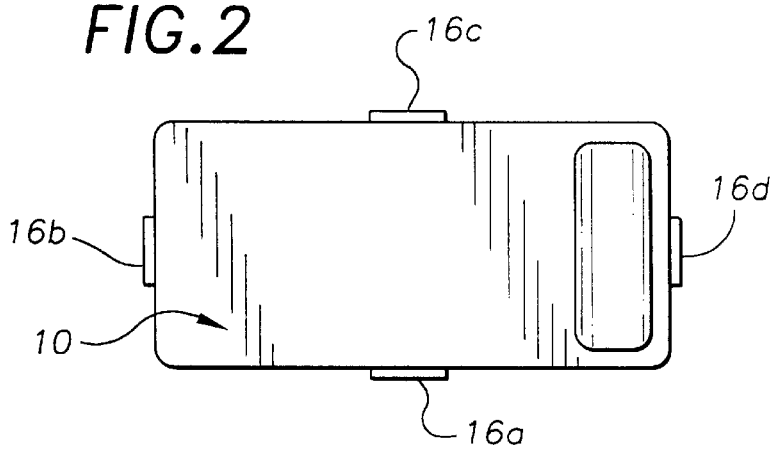
FIG. 2 is a top plan view of the exemplary flotation device of FIG. 1 showing placement of the four float anchoring assemblies along the cantilever side edges thereof.

Also shown in FIG. 1 are two of the four identical float anchoring assemblies 16*a–d* provided in this exemplary embodiment. Each float anchoring assembly 16*a–d* includes a section of pile material 18 from a hook and pile fastener and a flexible cover member 20 that folds over section 18 of pile material when nothing is secured thereto. With reference to FIG. 2, each of the four float anchoring assemblies 16*a–d* is permanently secured to a cantilever side edge surface of flotation device 10 with an adhesive.

Figure 3:
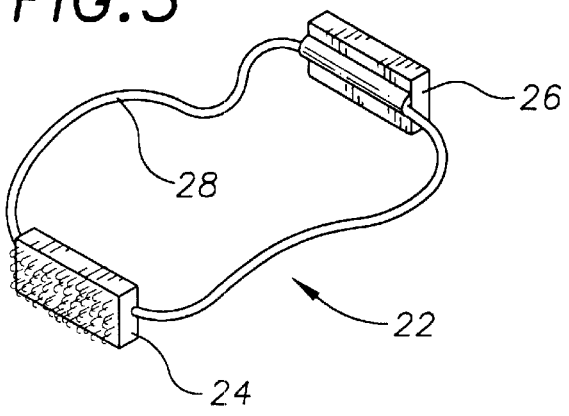
FIG. 3 is a perspective view of an exemplary anchor line of the anchoring system of the present invention showing the closed loop of flexible nylon rope and the identical first and second securing mechanisms slidably mounted onto the loop.
Figure 4:
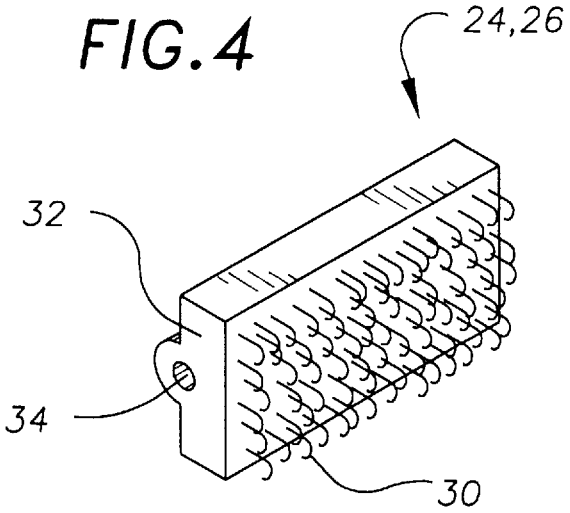
FIG. 4 is a perspective view of one of the identical first and securing mechanisms showing the mounting plate constructed from buoyant, resilient plastic, the tubular shaped connecting passageway formed therethrough for slidably receiving a section of the loop and a section of hook material from a hook and pile fastener.

FIG. 3 shows an exemplary embodiment of an anchoring line, generally designated 22. Anchoring line 22 includes a first securing mechanism 24, a second securing mechanism 26 and a loop of flexible nylon rope 28. First and second securing mechanism 24,26 are of identical. construction. With reference to FIG. 4, each securing mechanism 24,26 includes a section of hook material 30 from a hook and pile fastener that is secured to a mounting plate 32. Mounting plate 32 is constructed from a buoyant and resilient foam plastic and is provided with a tubular connecting passageway 34 formed entirely therethrough that is sized to slidingly receive Therethrough a portion of loop 28 (FIG. 3). The buoyant foam plastic material is sufficiently buoyant to keep securing mechanism 24,26 floating at the surface of a swimming pool when securing mechanism 24,26 is not attached. With reference back to FIG. 3, the ends of loop 28 are threaded through passageways 34 and then attached together by heat or otherwise to form a closed loop. Although loop 28 can be of any desired length, in this embodiment loop 28 has a length or twenty-four inches.

Figure 5:
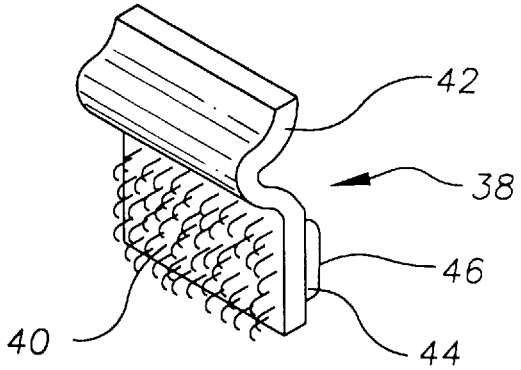
FIG. 5 is a perspective view of an exemplary one of the ten identical pool anchoring assemblies provided in the exemplary embodiment of the swimming pool float with anchoring system of the present invention showing the cover member folded upward to reveal the section of hook material from a hook and pile fastener, and the peel away cover member.
Figure 6:
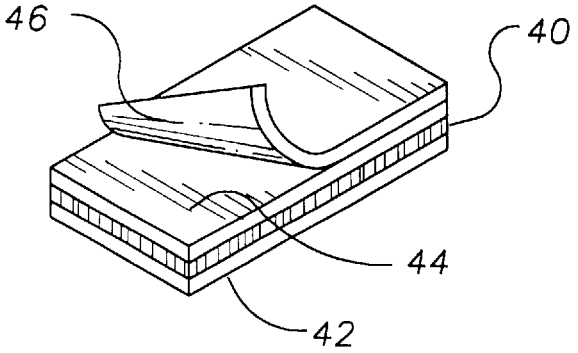
FIG. 6 is a perspective view of the pool anchoring assembly of FIG. 5 showing the peel away cover member partially peeled back to reveal a layer of water proof adhesive material.

FIG. 5 shows one of the ten pool anchoring assemblies 38 provided in this exemplary embodiment of the swimming pool float with anchoring system. All ten pool anchoring assemblies 38 are identical. Each pool anchoring assembly 38 includes a section of pile material 40 from a hook and pile fastener, a flexible cover member 42, a layer 44 of waterproof adhesive deposited on a back surface of section 40 (more clearly shown in FIG. 6), and a peel away cover member 46. FIG. 6 more clearly shows layer 44 and peel away cover member 46. Tn this embodiment, peel away cover member 46 is constructed from silicon coated paper.

Figure 7:
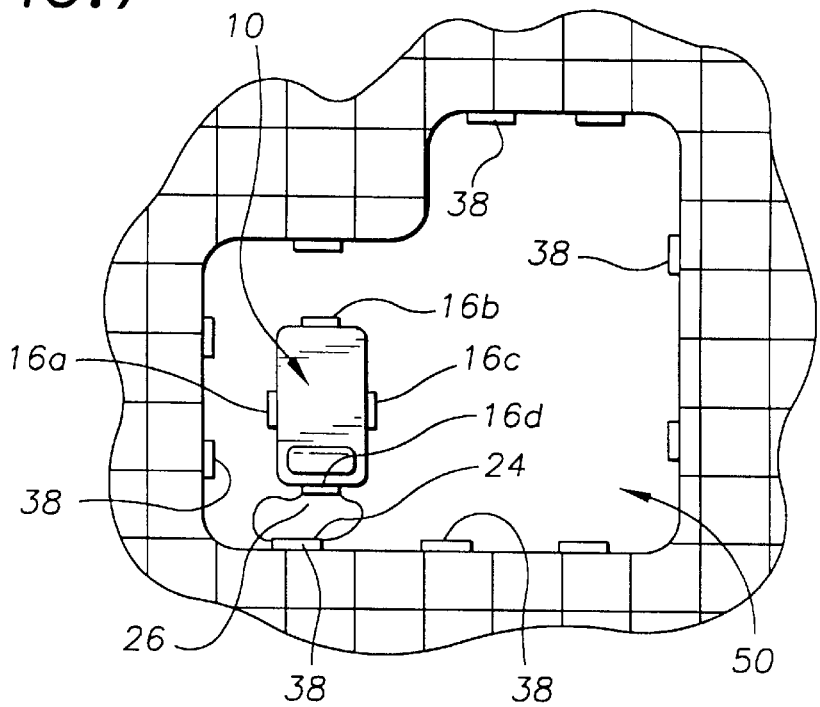
FIG. 7 is a top plan view of a representative swimming pool showing the pool anchoring assemblies secured to the cantilever side edge thereof at desirable locations the flotation device floating on the surface of the pool, and the anchoring line secured between one of the float anchoring assemblies and one of the pool anchoring assemblies.

FIG. 7 shows the exemplary flotation device 10, float anchoring assemblies 16*a–d*, anchor line 22, and ten pool anchoring assemblies 38 in use with a representative swimming pool 50. As shown in the figure, in use, pool anchoring assemblies 38 are secured to the cantilever side edge of swimming pool 50 by removing peel away cover members 46 and contacting adhesive layer 44 against the cantilever side edge of pool 50 at a desired location. Once pool anchoring assemblies 38 are in place, flotation device 10 can be anchored to any one of them by contacting a section 30 of hook material from a securing mechanism 24,26 against a section 40 of pile material of a pool anchoring assembly 38 arid similarly contacting a section 30 of hook material from the remaining securing mechanism 24,26 against a section 18 of pile material of a float anchoring assembly 16*a–d*.

Figure 8:
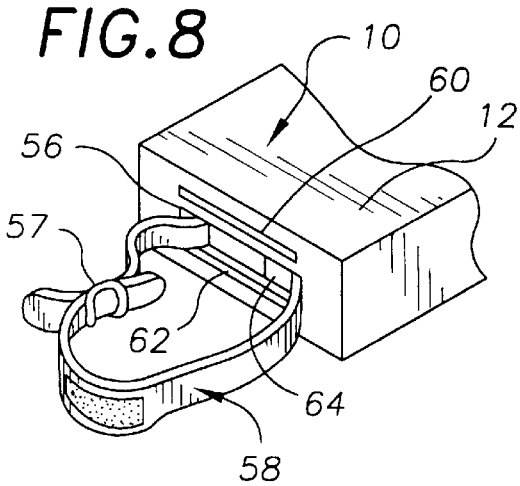
FIG. 8 is a detail perspective view of a second exemplary embodiment of the flotation device showing one of the four identical anchor line storage compartments formed into the closed cell foam flotation device, each anchor line storage compartment including an adjustable length anchor line attached to the interior wall thereof and upper and lower compartment cover securing strips provided, respectively, over and under a compartment opening through which the adjustable length anchor line is deployed.
Figure 9:
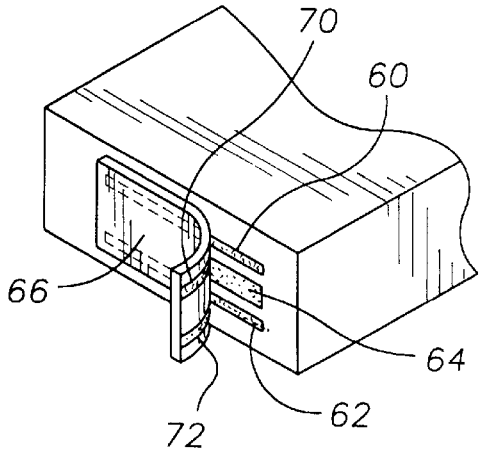
FIG. 9 is a detail perspective view of the second exemplary flotation device of FIG. 8 showing the adjustable length anchor line completely inserted within the storage anchor line storage compartment formed into the closed cell foam flotation device and the detachable compartment cover partially secured over the compartment opening to maintain the adjustable length anchor line completely within the storage anchor line storage compartment.

With reference to FIG. 8, a second exemplary embodiment of the flotation device 10 includes a body support 12 constructed from closed cell foam that includes four identical anchor line storage compartments, generally designated 56 (only one shown), that are formed into the closed cell foam body support 12 during the molding process. Each anchor line storage compartment 56 has an adjustable length anchor line, generally designated 58, permanently attached to the interior wall thereof. Each anchor line 58 includes an adjustment buckle 57 for adjusting the length of anchor line 58 and a securing mechanism 59 that is securable to one of the pool anchoring assemblies 38. Upper and lower hook and pile compartment cover securing strips 60,62 are provided, respectively, over and under a compartment opening 64. With reference to FIG. 9, four identical detachable compartment covers 66 (only one shown) each having two correspond hook and pile fastener strips 70,72 are provided for covering openings 64 after adjustable length anchor line

58 (FIG. 8) is completely inserted within its storage anchor line storage compartment 56 (FIG. 8).

It can be seen from the preceding description that a swimming pool float with an anchoring system is provided that allows the flotation device to be anchored in convenient proximity to a portion of the edge of the swimming pool; that includes a number of pool anchoring assemblies that are easily installed along the cantilever side edge of the swimming pool adjacent the perimeter edge thereof; and that includes an anchoring line that is easily detachable from the pool cantilever side edge while floating on the flotation device.

It is noted that the embodiment of the swimming pool float with anchoring system described herein in detail for exemplary purposes is of course subject to many different variations in structure, design, application and methodology. Because many varying and different embodiments may be made within the scope of the inventive concept(s) herein taught, and because many modifica tions may be made in the embodiment herein detailed in accordance with the descriptive requirements of the law, it is to be understood that the details herein are to be interpreted as illustrative and not in a limiting sense.

What is claimed is:

1. A swimming pool float with anchoring system comprising:

a flotation device;

at least one float anchoring assembly secured to said flotation device;

at least two pool anchoring assemblies securable to said cantilever side edge of a swimming pool, and a flexible anchoring line including a first securing mechanism securable to a float anchoring assembly and a second securing mechanism securable to one of said pool anchoring assemblies in a manner to anchor said flotation device to said cantilever side edge of said swimming pool;

said float anchoring assembly including a section of hook and pile fastener material and a flexible cover member that folds over said section of hook and pile fastener material when nothing is secured to said section of hook and pile fastener material.

2. The swimming pool float with anchoring system of claim 1, wherein:

said swimming pool float with anchoring system includes four said float anchoring assemblies, each of said four float anchoring assemblies being permanently secured to a cantilever side edge surface of said flotation device.

3. The swimming pool float with anchoring system of claim 1 wherein:

said pool anchoring assemblies and said at least one float anchoring assembly are identical, except a back surface of each of said pool anchoring assemblies is covered with a waterproof adhesive and a peel away cover member.

4. The swimming pool float with anchoring system of claim 1, wherein:

said anchoring line includes first and second securing mechanisms that each include a section of hook and pile fastener material that is secured to a mounting plate that, in-turn, is secured to a loop of flexible rope.

5. The swimming pool float with anchoring system of claim 2 wherein:

said pool anchoring assemblies and said at least one float anchoring assembly are identical, except a back surface of each of said pool anchoring assemblies is covered with a waterproof adhesive and a peel away cover member.

6. The swimming pool float with anchoring system of claim 2 wherein:

said anchoring line includes first and second securing mechanisms that each include a section of hook and pile fastener material that is secured to a mounting plate that, in-turn, is secured to a loop of flexible rope.

7. The swimming pool float with anchoring system of claim 5 wherein:

said anchoring line includes first and second securing mechanisms that each include a section of hook and pile fastener material that is secured to a mounting plate that, in-turn, is secured to a loop of flexible rope.

8. The swimming pool float with anchoring system of claim 3 wherein:

said anchoring line includes first and second securing mechanisms that each include a section of hook and pile fastener material that is secured to a mounting plate that, in-turn, is secured to a loop of flexible rope.

9. A swimming pool float with anchoring system comprising:

a flotation device;

at least one float anchoring assembly secured to said flotation device;

at least two pool anchoring assemblies securable to said cantilever side edge of a swimming pool, and a flexible anchoring line including a first securing mechanism securable to a float anchoring assembly and a second securing mechanism securable to one of said pool anchoring assemblies in a manner to anchor said flotation device to said cantilever side edge of said swimming pool, said anchoring line including first and second securing mechanisms that each include a section of hook and pile fastener material that is secured to a mounting plate that, in-turn, is secured to a loop of flexible rope;

said mounting plates being slidably mounted onto said loop of flexible rope and being each constructed of a sufficient quantity buoyant material to float at a surface of a swimming pool.

* * * * *